US007036561B2

(12) United States Patent
Yagi et al.

(10) Patent No.: US 7,036,561 B2
(45) Date of Patent: May 2, 2006

(54) HEAT EXCHANGER MODULE

(75) Inventors: Yoshinori Yagi, Kariya (JP); Tatsuo Ozaki, Okazaki (JP)

(73) Assignee: DENSO Corporation, Kariya (JP)

( * ) Notice: Subject to any disclaimer, the term of this patent is extended or adjusted under 35 U.S.C. 154(b) by 307 days.

(21) Appl. No.: 10/671,102

(22) Filed: Sep. 25, 2003

(65) Prior Publication Data

US 2004/0069443 A1 Apr. 15, 2004

(30) Foreign Application Priority Data

Sep. 27, 2002 (JP) ..... 2002-283136

(51) Int. Cl.
*F28F 9/02* (2006.01)

(52) U.S. Cl. ..... 165/67; 165/140

(58) Field of Classification Search ..... 165/67, 165/140, 149; 180/68.4
See application file for complete search history.

(56) References Cited

U.S. PATENT DOCUMENTS

| | | | | |
|---|---|---|---|---|
| 4,763,723 | A * | 8/1988 | Granetzke | 165/67 |
| 5,269,367 | A * | 12/1993 | Susa et al. | 165/41 |
| 5,996,684 | A * | 12/1999 | Clifton et al. | 165/67 |
| 6,059,019 | A * | 5/2000 | Brost et al. | 165/67 |
| 6,073,594 | A * | 6/2000 | Tsukiana et al. | 123/41.33 |
| 6,318,450 | B1 * | 11/2001 | Acre | 165/67 |
| 6,470,961 | B1 * | 10/2002 | Case | 165/78 |
| 6,510,891 | B1 * | 1/2003 | Anderson et al. | 165/67 |
| 6,513,579 | B1 * | 2/2003 | Kent et al. | 165/67 |
| 6,533,027 | B1 * | 3/2003 | Gille et al. | 165/67 |
| 6,684,937 | B1 * | 2/2004 | Lenz et al. | 165/41 |
| 6,691,767 | B1 * | 2/2004 | Southwick et al. | 165/67 |
| 6,705,387 | B1 * | 3/2004 | Kokubunji et al. | 165/67 |
| 6,742,615 | B1 * | 6/2004 | Cristante et al. | 180/68.4 |
| 6,827,129 | B1 * | 12/2004 | Ozawa et al. | 165/67 |
| 2002/0157812 | A1 * | 10/2002 | Anderson et al. | 165/67 |
| 2004/0188061 | A1 * | 9/2004 | Beck et al. | 165/67 |
| 2005/0092462 | A1 * | 5/2005 | Makino et al. | 165/67 |

FOREIGN PATENT DOCUMENTS

| | | |
|---|---|---|
| JP | 11-142084 | 5/1999 |
| JP | 11-324693 | 11/1999 |

* cited by examiner

*Primary Examiner*—Allen J. Flanigan
(74) *Attorney, Agent, or Firm*—Harness, Dickey & Pierce, PLC

(57) ABSTRACT

Brackets 3 made of resin are provided between the radiator 1 and the condenser 2, and the heat exchangers 1 and 2 are secured to the brackets 3, so that heat transfer from the radiator 1 to the condenser 2 can be restricted and reduction of the cooling efficiency of the condenser 2 can be prevented. The radiator 1 and the condenser 2 are assembled with and secured to the brackets 3 so that the position of the condenser 2 with respect to the radiator 1 can be easily determined. Therefore, the assembling of the cooling module can be facilitated and no heat exchange between the radiator 1 and the condenser 2 can be restricted due to a predetermined space provided between the core 1*c* of the radiator 1 and the core 2*c* of the condenser 2.

6 Claims, 12 Drawing Sheets

HEAT EXCHANGER MODULE

BACKGROUND OF THE INVENTION

1. Field of the Invention

The present invention relates to a heat exchanger module, in which at least a first heat exchanger and a second heat exchanger are integrated with each other through brackets, and can be effectively applied to a cooling module in which a radiator for a vehicle and an external heat exchanger of an air conditioner for a vehicle are integrated.

2. Description of the Related Art

Conventionally, a radiator and a condenser are integrated by inserts (side plates) or fins, etc., and mounting brackets for mounting the same to a vehicle are secured to header tank portions (see Japanese Unexamined Patent Publication No. 11-142084, for example).

Before making the radiator and the condenser integral with each other, the radiator and the condenser must be manufactured separately, because the specifications thereof are quite different.

In this regard, according to a prior art disclosed in Japanese Unexamined Patent Publication No. 11-142084, a cooling module in which a radiator has already been integrated with a condenser is mounted in a vehicle through brackets. Thus, it is difficult to apply the prior art to the cooling module in which both of the heat exchangers, i.e., the radiator and the condenser, are integrated with each other after they are manufactured separately.

SUMMARY OF THE INVENTION

In view of the above problem, the present invention is aimed at provision of a structure applicable to a heat exchanger module in which at least two heat exchangers are integrated with each other after they are manufactured separately.

To achieve the above objective, according to the present invention, a heat exchanger module comprises a first heat exchange 1 and a second heat exchanger 2 which are integrated with each other through brackets 3, the first and second heat exchangers 1 and 2 each being constituted by solder-brazing a plurality of tubes and header tanks connected thereto, which are located at opposite ends of the plurality of tubes in the longitudinal direction, wherein the first and second heat exchangers 1 and 2 are arranged with core surfaces thereof being opposed to each other, the brackets 3 are provided with mounting parts 3*b* for mounting the heat exchangers 1 and 2 to a vehicle, and the brackets 3 are made of resin and located between the heat exchangers 1 and 2.

The brackets 3 made of resin having lower thermal conductivity than a metal are located between the heat exchangers 1 and 2, so that heat transfer, from the heat exchanger on a higher temperature side to the heat exchanger on a lower temperature side, can be restricted.

A predetermined space must be provided between cores of the heat exchanger 1 and 2. According to the present invention, the heat exchangers 1 and 2 are assembled with and secured to the brackets 3 so that, for example, the position of the second heat exchanger 2 with respect to the first heat exchanger 1 can be easily determined. Therefore, the assembling of the heat exchanger module can be facilitated and heat exchange between the first and second heat exchangers 1 and 2 can be restricted, due to a predetermined space provided between the cores of the heat exchangers 1 and 2.

According to the present invention, the bracket 3 has mounting parts 3*b* and bracket body 3*a* in the form of a strip plate which is located between a header tank 1*d* of the first heat exchanger 1 and a header tank 2*d* of the second heat exchanger 2.

According to the present invention, the mounting part 3*b* is provided, on a mounting stay 3*c* projecting from an end side of the bracket body 3*a* in the longitudinal direction, in a direction substantially orthogonal to the longitudinal direction of the bracket body 3*a*. The mounting stay 3*c* is provided on its root side with a reinforcing part 3*d* to resist a moment acting on the mounting stay 3*c*.

Further, according to the present invention, the mounting stay 3*c* projects from the bracket body 3*a* toward the core sides of the heat exchangers 1 and 2 and the reinforcing part 3*d* has through holes 3*e* extending in a direction orthogonal to the core surface.

As the holes 3*e* permit the cooling air to pass therethrough, the reinforcing parts 3*d*, which would otherwise obstruct the cooling air flowing through the core, can enhance the rigidity of the brackets 3 without reducing the cooling efficiency of the heat exchanger module.

According to the present invention, the brackets 3 are located on opposite end sides of the heat exchangers 1 and 2, and at least one of the brackets 3 are secured to the heat exchangers 1 and 2 by pin-shaped securing means 4 extending in a direction orthogonal to the core surface.

Due to this arrangement, if a hole in which the securing means 4 is inserted is larger than the diameter of the securing means 4 or is an elongated hole, a dimensional difference between the heat exchangers 1 and 2 can be easily absorbed, so that the brackets 3 can be easily mounted to the heat exchangers 1 and 2.

Further, according to the present invention, a fan mounting part 3*f* for mounting a fan, to feed air to the heat exchangers 1 and 2, is provided in the vicinity of the mounting part 3*b*.

The present invention may be more fully understood from the description of preferred embodiments of the invention, as set forth below, together with the accompanying drawings.

DESCRIPTION OF THE PREFERRED EMBODIMENTS (Embodiment 1)

According to the present embodiment, a heat exchanger module of the present invention is applied to a cooling module in which a radiator for a vehicle, and an external heat exchanger of an air conditioner for a vehicle, are integrated.

Figure 1:
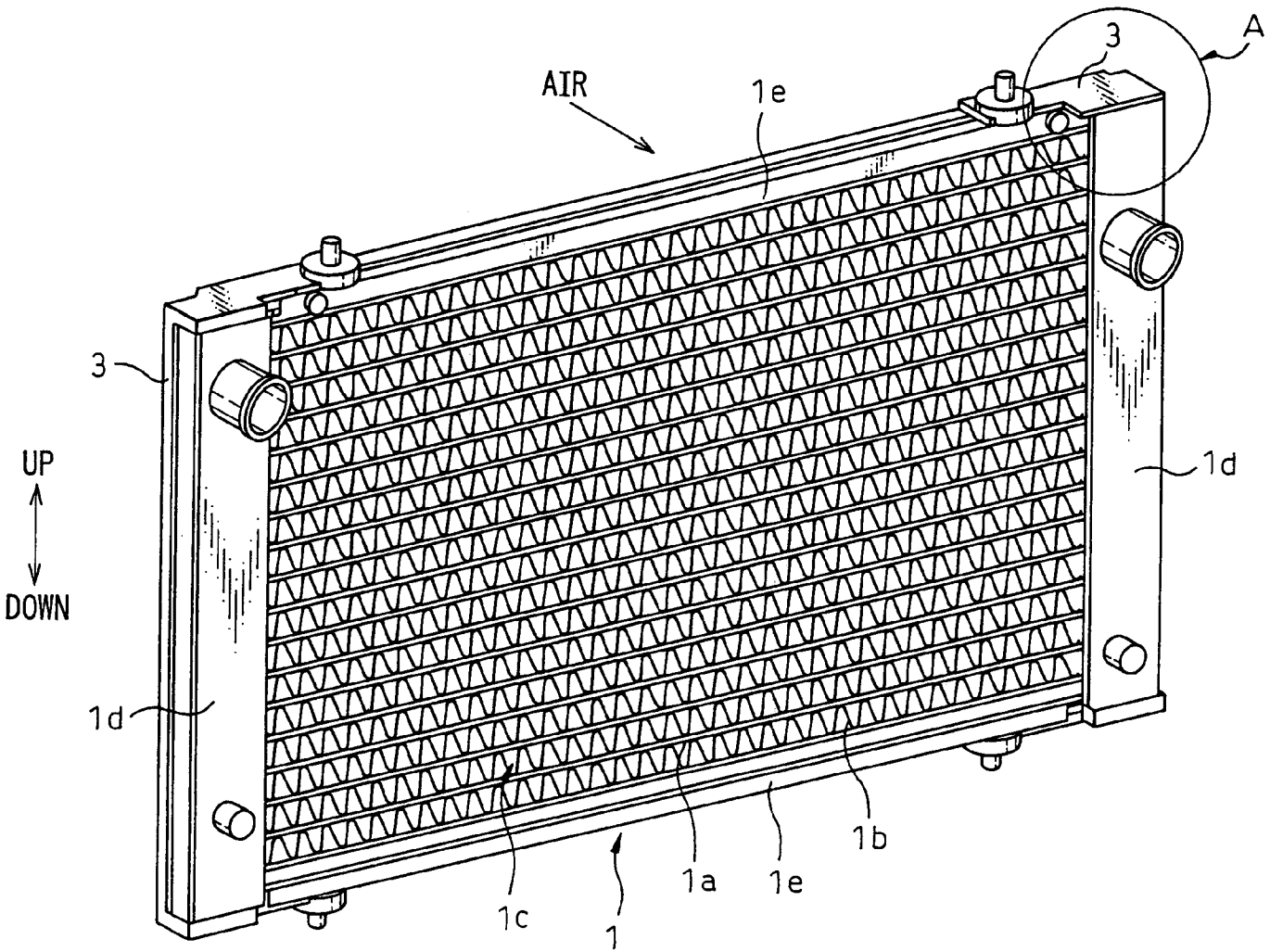
FIG. 1 is a perspective view of a cooling module according to Embodiment 1 of the present invention, viewed from the downstream side of an air flow.
Figure 2:
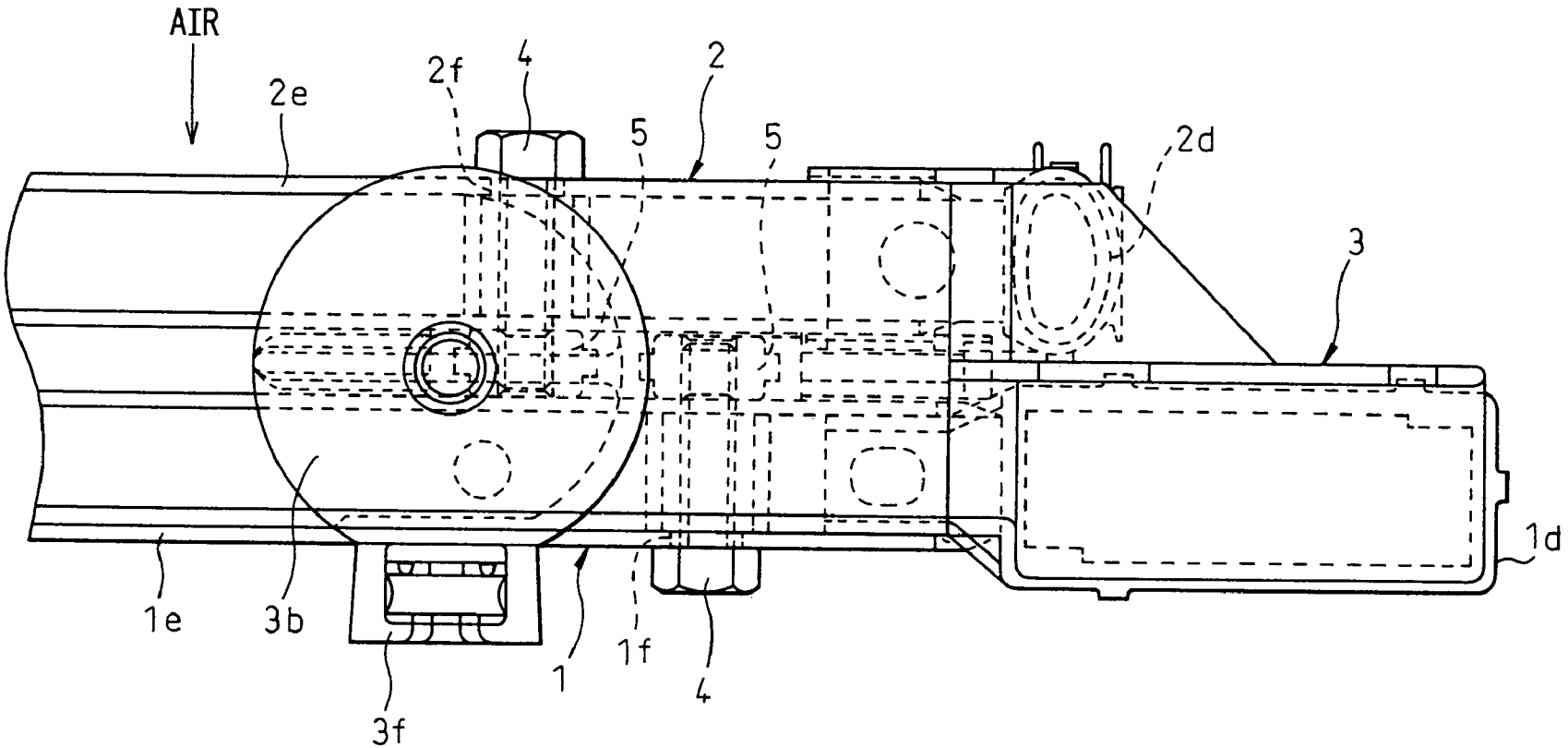
FIG. 2 is a top view of a part "A" in FIG. 1.
Figure 3:
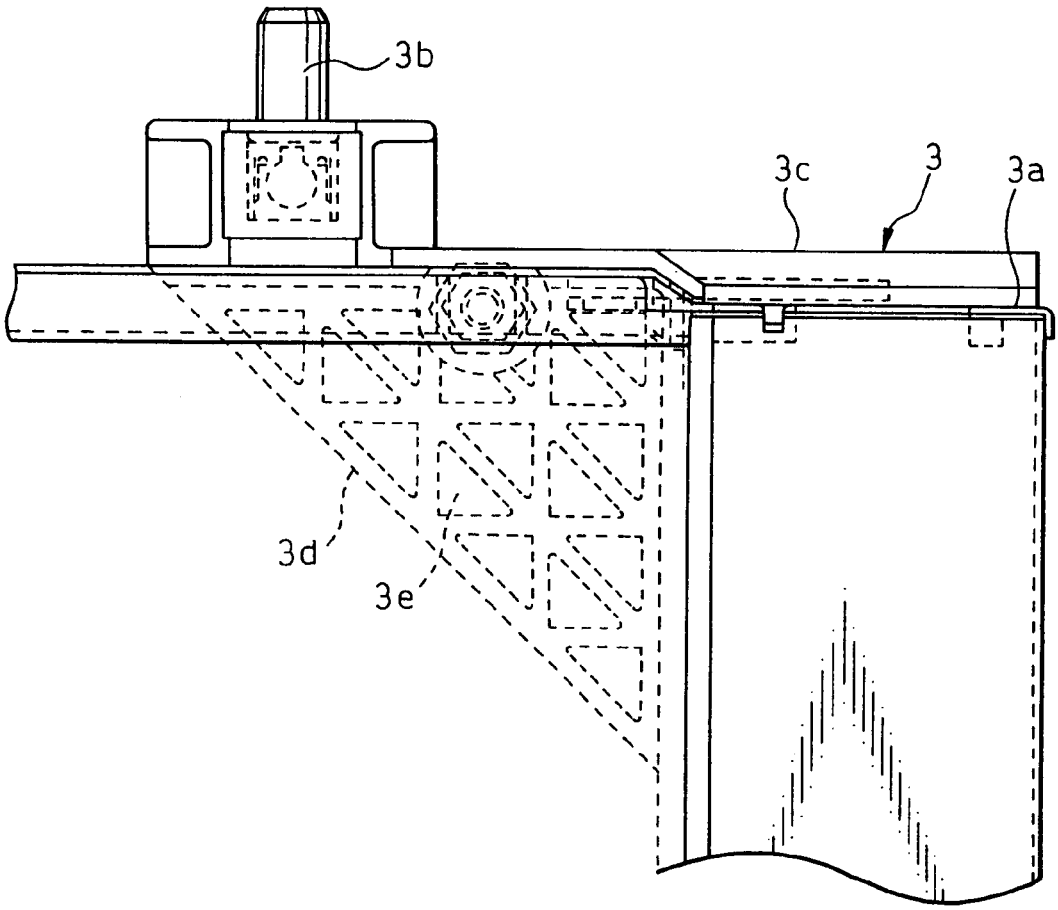
FIG. 3 is a front view of a part "A" in FIG. 1.
Figure 4:
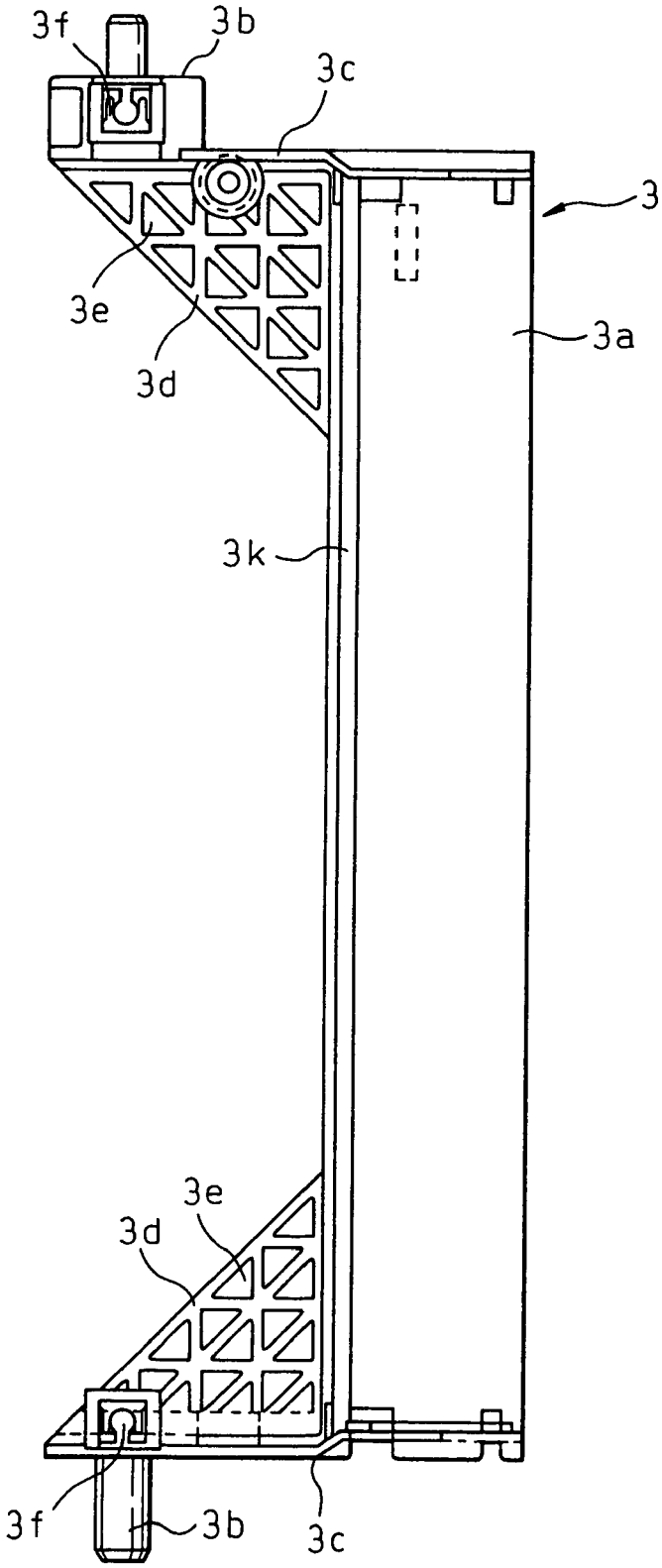
FIG. 4 is a front view of a bracket according to Embodiment 1 of the present invention.

FIG. 1 is a perspective view of a cooling module of Embodiment 1 viewed from a downstream side of an air flow. FIG. 2 is a top view of A-part in FIG. 1. FIG. 3 is a front view of A-part in FIG. 1. FIG. 4 is a front view of a bracket 3.

A radiator 1 cools cooling water due to a heat-exchange between the cooling water circulating in an engine and the air. A condenser 2 (see FIG. 2) cools and condenses high-pressure refrigerant discharged from a compressor.

The radiator 1 and the condenser 2 are substantially identical in structure. In particular, as shown in FIG. 1, the radiator 1 and the condenser 2 are each comprised of a core 1*c* having a plurality of tubes 1*a* through which fluid, i.e., cooling water in the radiator 1 or refrigerant in the condenser 2, and having fins 1*b* welded to external surfaces of the tubes 1*a* to increase a heat transfer surface area in contact with the air, having header tanks 1*d* which are connected to the plurality of tubes a at opposite ends of the plurality of tubes 1*a* in the longitudinal direction and which extend in a direction substantially orthogonal to the longitudinal direction of the tubes 1*a*, and having inserts 1*e* which are located at opposite ends of the core 1*c* and which extend parallel to the longitudinal direction of the tubes 1*a* to reinforce the core 1*c*, etc. According to the present embodiment, all of the above components, being made of aluminum alloy, are integrated by solder-brazing.

The condenser 2 is not shown in FIG. 1 and, hence, numerals are assigned to the tubes, the fins, the core, the header tanks and the inserts of the radiator 1, only.

"Solder-brazing", as described in "Connection-Cementation Technology" (published by Tokyo Denki University Press), refers to bonding by means of braze or solder, without fusing a base material. The bonding using a filler metal, called a brazing material, whose fusing point is not less than 450° C. is referred to as brazing. The bonding by the use of a filler, called solder, whose fusing point is not more than 450° C. is referred to as soldering.

As shown in FIG. 2, the radiator 1 and the condenser 2 are arranged with core surfaces thereof being opposed to each other with a determined space. The radiator 1 and the condenser 2 are secured to brackets 3 located therebetween, are integrated with each other, and are mounted to a vehicle body through the brackets 3.

As shown in FIG. 4, the bracket 3 has the bracket body 3*a* in the form of a strip plate extending in the upward and downward direction at the portion between the header tank 1*d* of the radiator 1 and the header tank 2*d* (see FIG. 2), that is, the portion corresponding to the ends of the radiator 1 and the condenser 2, the mounting parts 3*b* for mounting the radiator 1 and the condenser 2, i.e., the cooling module, which are integrated through the brackets 3, to a vehicle body, and the mounting stays 3*c*, etc., in the form of strip plates projecting from end sides of the bracket body 3*a* in the longitudinal direction, in a direction substantially orthogonal to the longitudinal direction of the bracket body 3*a*, i.e., toward core sides of the radiator 1 and the condenser 2, according to the present embodiment. The mounting parts 3*b* are provided on front end sides of the mounting stays 3*c*.

The mounting stays 3*c* are provided on their root sides with generally triangular plate shaped reinforcing parts 3*d* which serve as reinforcing members to resist a moment acting on the mounting stays 3*c*. The reinforcing parts 3*d* have a plurality of through holes 3*e* extending in a direction orthogonal to the core surfaces, i.e., in a direction of an air flow.

According to the present embodiment, the reinforcing part 3*d* has a truss structure, by making the shapes of the holes 3*e* substantially triangular, so that no substantial reduction of the strength occurs.

Figure 5:
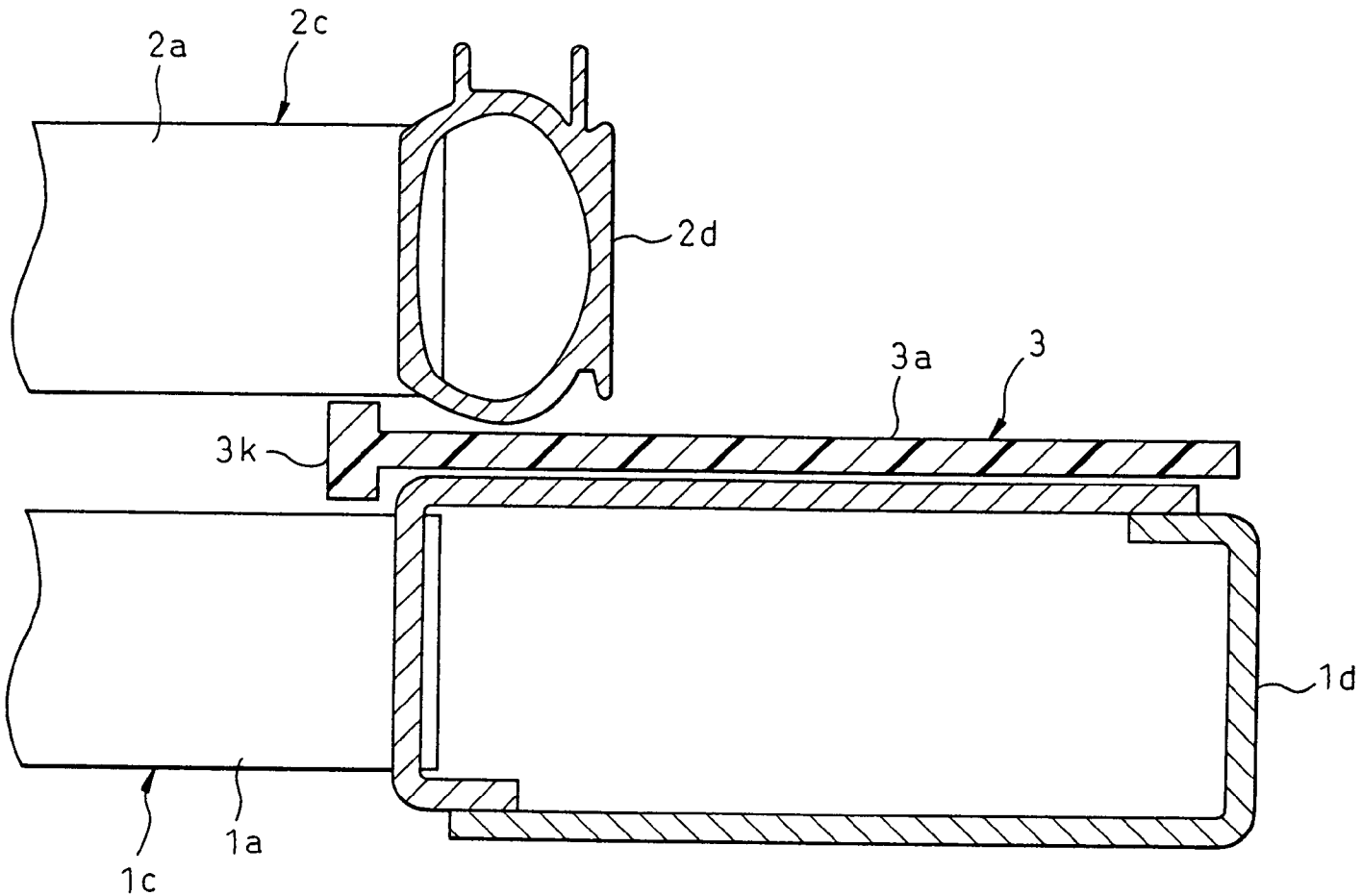
FIG. 5 is a sectional view of a bracket, etc., according to Embodiment 1 of the present invention.

The bracket body 3*a* extends from parts corresponding to the header tanks 1*d* and 2*d* toward sides of the cores 1*c* and 2*c*, as shown in FIG. 5.

According to the present embodiment, the bracket bodies 3*a*, the mounting parts 3*b*, the mounting stays 3*c* and the reinforcing parts 3*d* are integrally molded by means of resin (e.g., glass-fiber-imbedded nylon).

At least one of the right and left brackets 3 of the cooling module (both the brackets in the present embodiment) is secured, on its upper end side, to the radiator 1 and the condenser 2 through bolts 4 which serve as a pin-shaped securing means extending in a direction orthogonal to the core surfaces, as shown in FIG. 2.

The inserts 1*e* and 2*e* are each comprised of a bottom surface and two opposite side walls raised from the bottom surface and are in the form of a channel generally of a U-shape in cross section.

Figure 6:
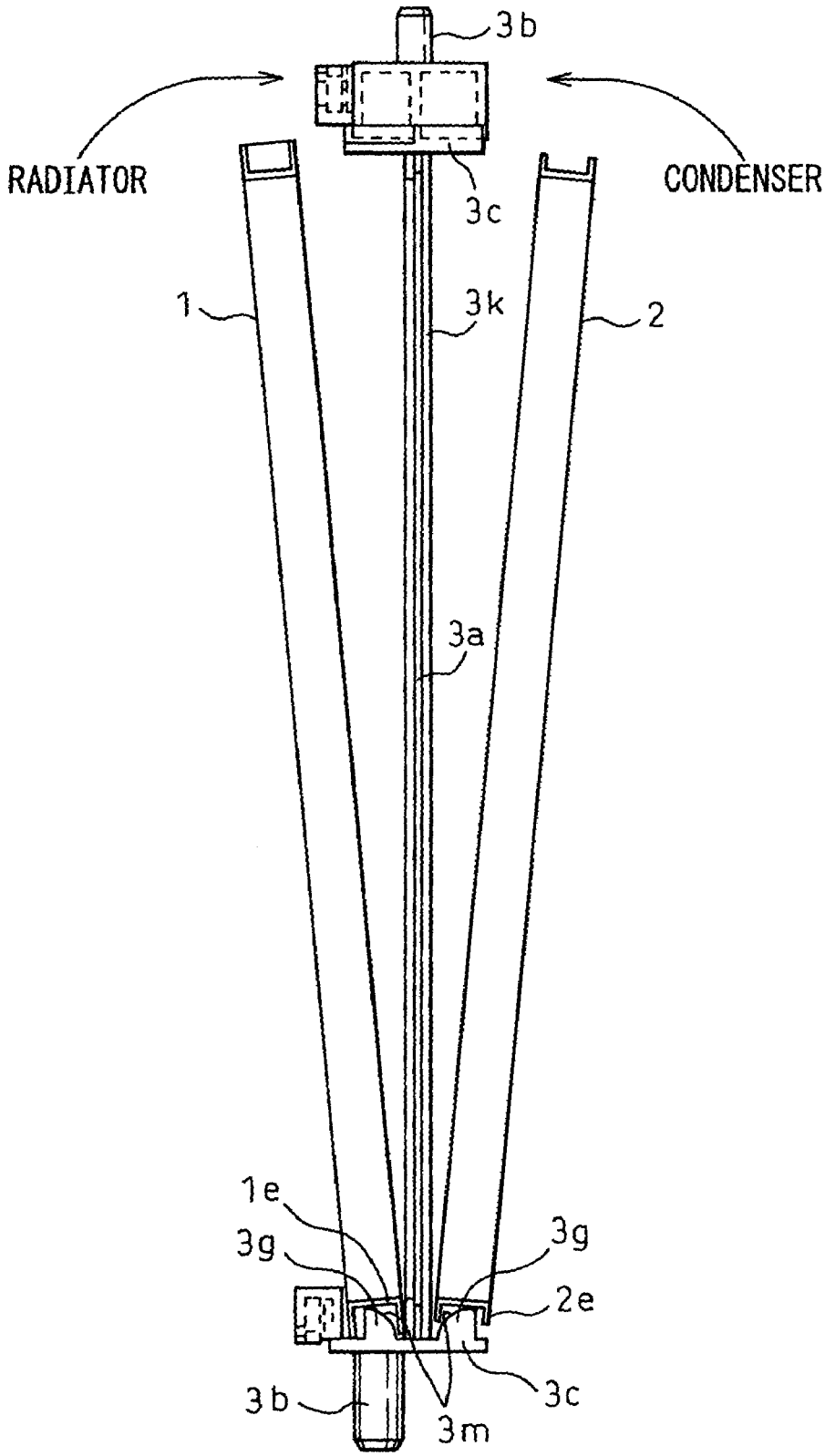
FIG. 6 shows how to assemble a cooling module according to Embodiment 1 of the present invention.

As shown in FIG. 6, the lower ends of the radiator 1 and the condenser 2 are secured to the brackets 3 by fitting the projections 3*g* provided on the lower end sides of the brackets 3, in the substantially U-shaped recesses of the inserts le and 2*e*. The projections 3*g* are provided with tapered parts 3*m* obliquely oriented to the bracket body 3*a* side.

According to the present embodiment, as shown in FIG. 2, nuts 5 are embedded in the reinforcing parts 3*d* and are integrated with the brackets 3 when the brackets 3 are manufactured, so that the bolts 4 are inserted and fastened in the nuts 5 through bolt holes if and 2*f* provided in the inserts 1*e* and 2*e*.

The fan mounting parts 3*f* for mounting a fan shroud are provided integrally to the brackets 3 in the vicinity of the mounting parts 3*b*. The fan shroud covers the stays for mounting the fan to blow cooling air to the cooling module, the cooling module and the fan, in order to prevent an airflow induced by the fan from detouring around the cooling module.

Next, the operation and the effect of the embodiment will be explained.

According to the present embodiment, the brackets 3 are made of resin and are located between the radiator 1 and the condenser 2 so that heat exchange between the radiator 1 and the condenser 2 can be restricted.

That is, because the temperature of the cooling water circulating in the radiator 1 is higher than that of the cooling medium circulating in the condenser 2, if the radiator 1 and the condenser 2 are integrated in close contact with each other, a heat transfer from the radiator 1 to the condenser 2 occurs, thus leading to reduction of the cooling efficiency of the condenser 2. However, according to the present embodiment, the brackets 3 made of resin, whose thermal conductivity is lower than that of a metal, are provided between the radiator 1 and the condenser 2, so that heat transfer from the radiator to the condenser 2 can be restricted and reduction of the cooling efficiency of the condenser 2 can be prevented.

A predetermined space must be provided between the core 1*c* of the radiator 1 and the core 2*c* of the condenser 2. According to the present embodiment, the radiator 1 and the condenser 2 are assembled with and secured to the brackets 3 so that the position of the condenser 2 with respect to the radiator 1 can be easily determined. Therefore, the assembling of the cooling module can be facilitated and heat exchange between the radiator 1 and the condenser 2 can be restricted, due to a predetermined space provided between the core 1*c* of the radiator 1 and the core 2*c* of the condenser 2.

Further, the mounting parts 3*b* for mounting the cooling module to a vehicle are provided in the brackets 3 and, thus, a dimensional difference between the upper mounting parts 3*b* and the lower mounting parts 3*b* is within a manufacturing tolerance (manufacturing irregularity) of the brackets 3.

If the mounting parts 3*b* were provided in the radiator 1 or the condenser 2, a dimensional difference between the upper mounting parts 3*b* and the lower mounting parts 3*b* would be within a manufacturing tolerance (allowable manufacturing irregularity) of the radiator 1 or the condenser 2. Nevertheless, if the mounting parts 3*b* are provided in the brackets 3, the dimensional difference between the upper and lower mounting parts 3*b* becomes smaller, because the brackets 3 are resin-molded products and the radiator 1 and the condenser 2 are brazed products.

Consequently, the dimensional difference between the upper mounting parts 3*b* and the lower mounting parts 3*b* can be made smaller so that the mounting operation of the cooling module to a vehicle can be facilitated.

The reinforcing parts 3*d* have through-holes 3*e* extending in a direction orthogonal to the core surfaces of the core 1*c* and the core 2*c*. As the holes 3*e* permit the cooling air to pass therethrough, the reinforcing parts 3*d*, which would otherwise obstruct the cooling air flowing through the cores 1*c* and 2*c*, can enhance the rigidity of the brackets 3 without reducing the cooling efficiency of the cooling module.

According to the present embodiment, the radiator 1 and the condenser 2 are integrated through the brackets 3 and the brackets 3 are provided on opposite end sides of the both heat exchangers. If the radiator 1 is different in size from the condenser 2, both the radiator 1 and the condenser 2 may not be mounted to the brackets 3.

However, according to the present embodiment, the radiator 1 and the condenser 2 are secured to the brackets 3 through the bolts 4 extending in a direction orthogonal to the core surfaces. If holes in which the bolts 4 are inserted are larger than the diameters of the bolts 4 or are elongated holes, a dimensional difference between the radiator 1 and the condenser 2 can be easily absorbed, so that the radiator 1 and the condenser 2 can be easily mounted to the brackets 3.

As the fan mounting parts 3*f* are provided in the vicinity of the mounting parts 3*b*, the heat exchangers 1 and 2 are free from the weight of the fan and the fan shroud.

According to the present embodiment, as the bracket bodies 3*a* extend from portions corresponding to the header tanks 1*d* and 2*d* to the cores 1*c* and 2*c*, it is possible to provide the bracket bodies 3*a* with reinforcing flanges 3*k*, so that the bracket bodies 3*a* generally exhibit a T-shape in cross section as shown in FIG. 5. Consequently, the flexural rigidity and the buckling strength of the bracket bodies 3*a* can be increased.

As the tubes 1*a* and 2*a* have widths (distance between parallel parts in the air flow direction) which are normally smaller than those of the header tanks 1*d* and 2*d*, the flanges 3*k* can be arranged on the cores 1*c* and 2*c* sides.

(Embodiment 2)

Figure 7C:
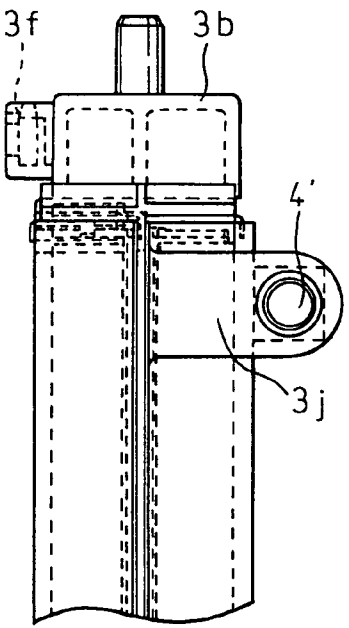
FIGS. 7A, 7B and 7C are three different views of a significant component of a cooling module according to Embodiment 2 of the present invention.
Figure 7A:
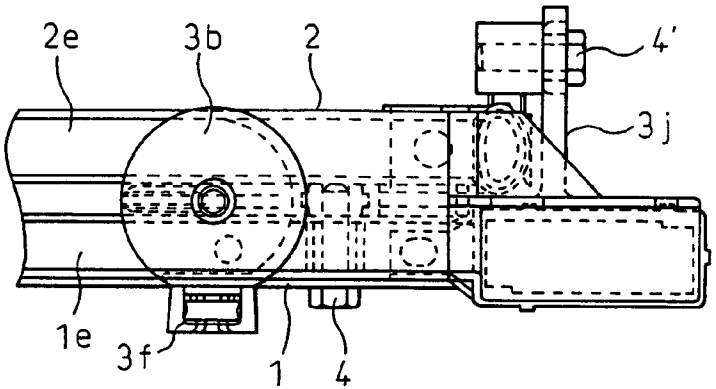
Figure 7B:
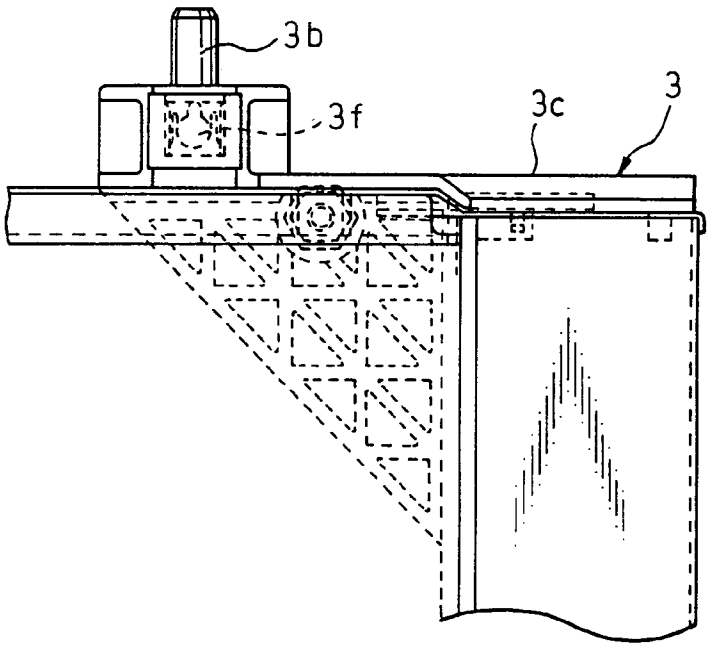

Though the radiator 1 and the condenser 2 are secured to the brackets 3 through the bolts 4 extending in a direction orthogonal to the core surfaces in Embodiment 1, according to the present embodiment, as shown in FIGS. 7A–7C, the condenser 2 is secured to the brackets 3 through the bolts 4' extending parallel to the core surfaces.

The bracket bodies 3*a* are provided with stays 3*j* for fastening the condenser 2.

(Embodiment 3)

Figure 8C:
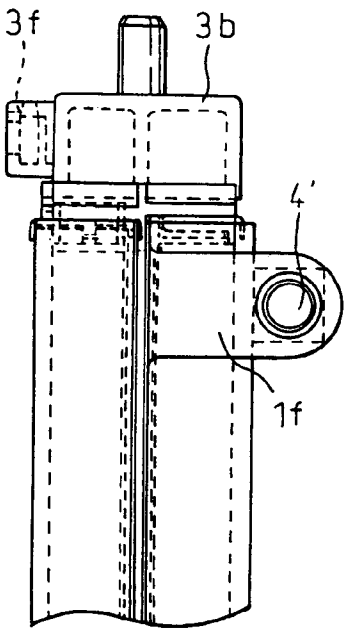
FIGS. 8A, 8B and 8C are three different views of a significant component of a cooling module according to Embodiment 3 of the present invention.
Figure 8A:
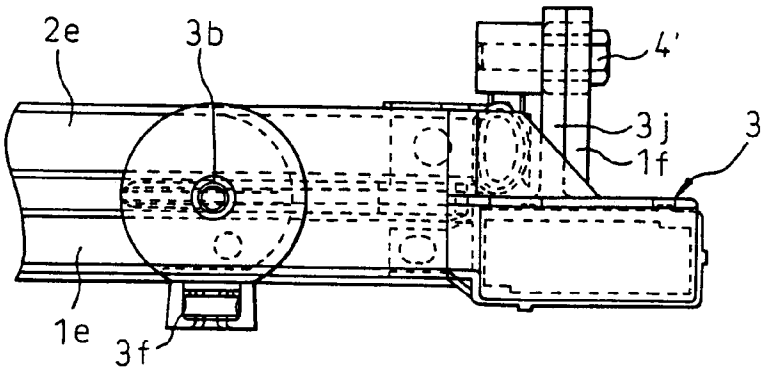
Figure 8B:
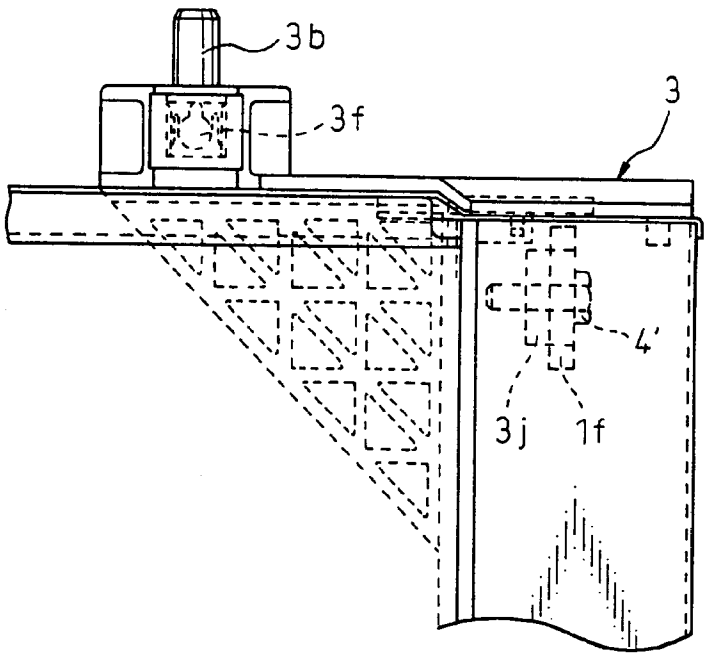

According to the present embodiment, as shown in FIGS. 8A–8C, the mounting stays if provided on the radiator 1 are united to the stays 3*j*, and both the radiator 1 and the condenser 2 are secured by fastening the bolts 4'.

(Embodiment 4)

Figure 9A:
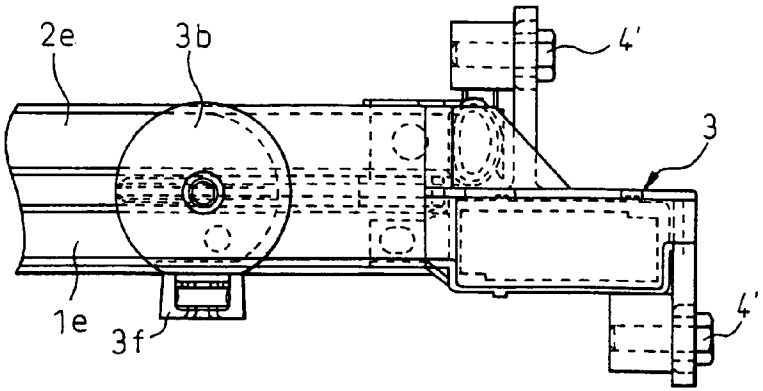
FIGS. 9A, 9B and 9C are three different views of a significant component of a cooling module according to Embodiment 4 of the present invention.
Figure 9B:
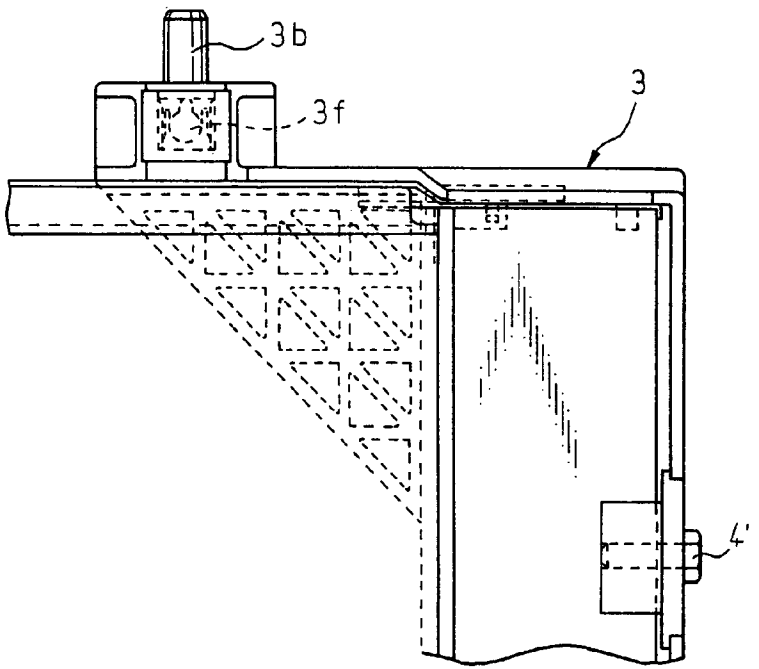
Figure 9C:
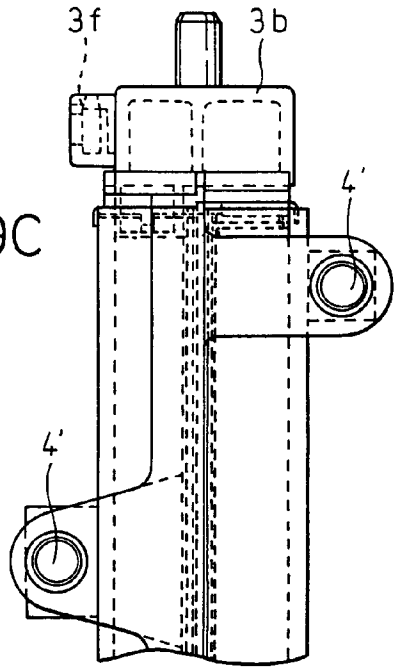

According to the present embodiment, as shown in FIGS. 9A–9C, the radiator 1 and the condenser 2 are secured to the brackets 3 through the bolts 4' extending parallel to the core surfaces.

(Embodiment 5)

Figure 10A:
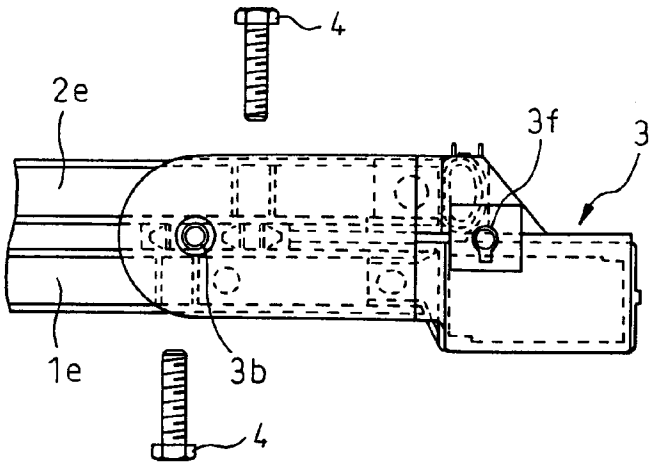
FIGS. 10A, 10B and 10C are three different views of a significant component of a cooling module according to Embodiment 5 of the present invention.
Figure 10B:
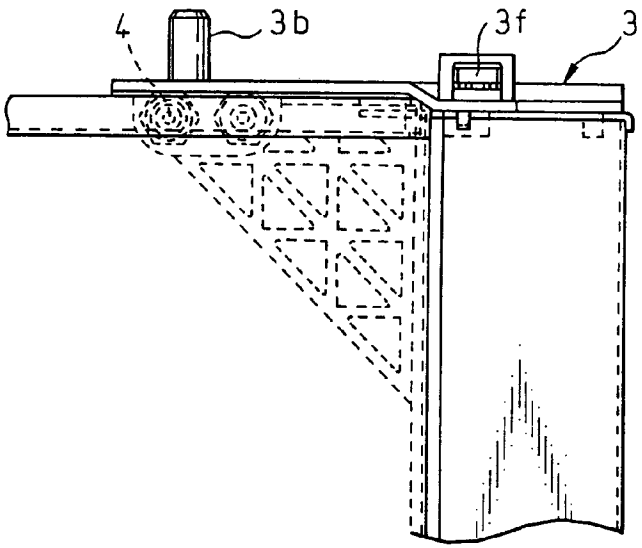
Figure 10C:
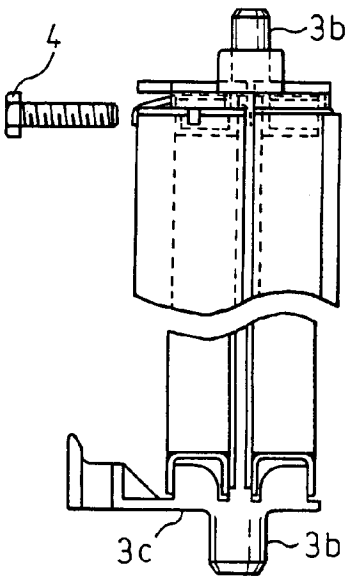

According to the present embodiment, as shown in FIGS. 10A–10C, the fan mounting parts 3*f* are provided on corresponding portions of the brackets 3 at the ends of the header tanks 1*d* and 2*d* in the longitudinal direction.

(Embodiment 6)

Figure 11:
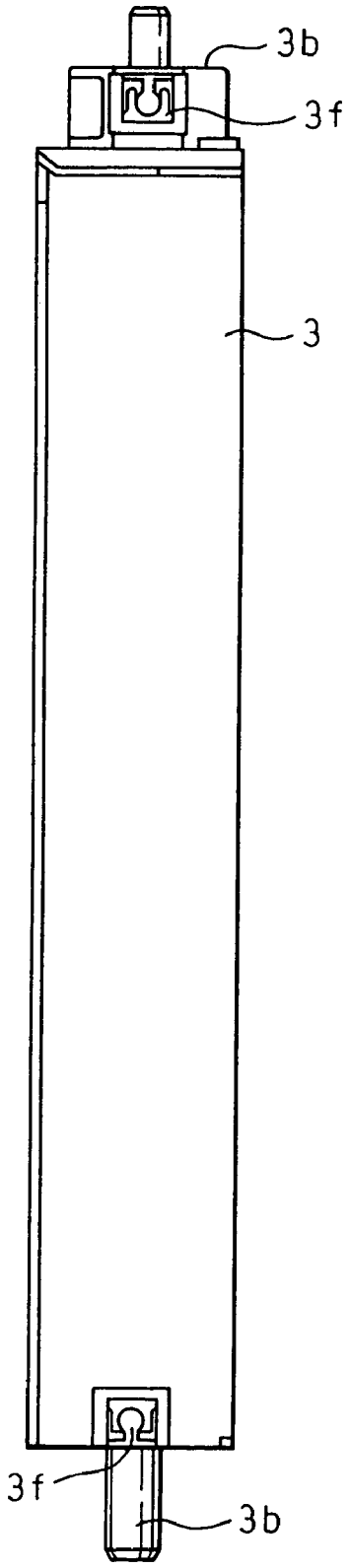
FIG. 11 is a front view of a bracket according to Embodiment 6 of the present invention.

According to the present embodiment, as shown in FIG. 11, the mounting parts 3*b* are provided on the brackets 3 at their parts corresponding to the ends in the longitudinal direction of the header tanks 1*d* and 2*d*.

(Embodiment 7)

Figure 12:
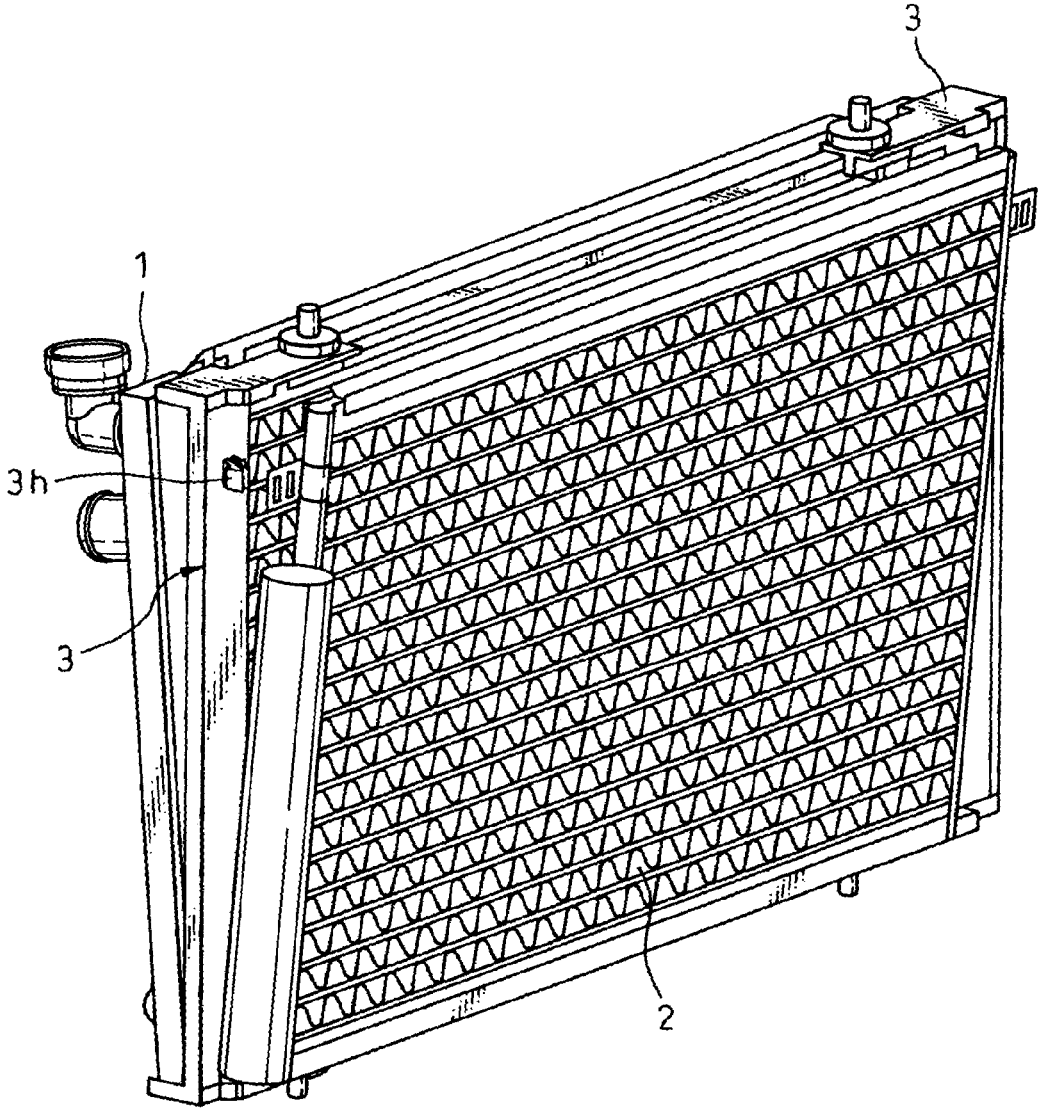
FIG. 12 is a perspective view of a cooling module, according to Embodiment 7 of the present invention, viewed from the upstream side of an air flow.

Though the heat exchangers 1 and 2 are secured to the brackets 3 through the bolts in the above embodiments, according to the present embodiment, as shown in FIG. 12, the heat exchanger (the condenser 2 in FIG. 12) is secured to the brackets 3 through snap-fits 3*h*.

The snap-fits constitute a means for detachably securing two members, due to an elastic deformation of projections in the form of hook-shaped pins.

(Other Embodiments)

In the above embodiments, the bracket bodies 3*a* are provided between the header tanks 1*d* and 2*d* but the present invention is not limited thereto.

In the above embodiments, the heat exchanger modules are comprised of the radiator and the condenser, but the present invention is not limited thereto and may be applied to a module comprised of other heat exchangers.

While the invention has been described by reference to specific embodiments chosen for purposes of illustration, it should be apparent that numerous modifications could be made thereto by those skilled in the art without departing from the basic concept and scope of the invention.

The invention claimed is:

1. A heat exchanger module in which a first heat exchanger and a second heat exchanger are integrated with each other through brackets, said first and second heat exchangers being each constituted by solder-brazing a plurality of tubes and header tanks connected thereto, which are located at opposite ends of the plurality of tubes in the longitudinal direction, wherein the heat exchangers are arranged with core surfaces thereof being opposed to each other;

the brackets are provided with mounting parts for mounting the heat exchangers to a vehicle;

the brackets are made of resin and located between the heat exchangers;

the brackets have the mounting parts and bracket bodies in the form of strip plates; and the bracket bodies are located between the header tanks of the first heat exchanger and the header tanks of the second heat exchanger.

2. A heat exchanger module as set forth in claim 1, wherein the brackets have bracket bodies in the form of strip plates and mounting stays, the mounting stays projecting from the end sides of the bracket bodies in the longitudinal direction, in a direction substantially orthogonal to the longitudinal direction of the bracket bodies and provided with the mounting parts on the mounting stays, said mounting stays are provided on their root sides with reinforcing parts to resist a moment acting on the mounting stays.

3. A heat exchanger module as set forth in claim 2, wherein the mounting stays project from the bracket bodies toward the core sides of the heat exchangers, said reinforcing parts having through holes extending in a direction orthogonal to the core surfaces.

4. A heat exchanger module as set forth in claim 1, wherein the brackets are provided on opposite end sides of the heat exchangers, and at least one of the brackets is secured to the heat exchangers by pin-shaped securing means extending in a direction orthogonal to the core surfaces.

5. A heat exchanger module as set forth in claim 1, comprising fan mounting parts, for mounting a fan to move air through the heat exchangers, in the vicinity of the mounting parts.

6. A heat exchanger module as set forth in claim 1, wherein the first and second heat exchangers have channeled inserts which are located on the outermost sides of the plurality of tubes and are each comprised of a bottom surface and two opposite side walls raised from the bottom surface, said brackets being each provided with a bracket body in the form of a strip plate and a lower mounting stay which projects from the lower end side of the bracket body in the longitudinal direction, in a direction substantially orthogonal to the longitudinal direction of the bracket body and on which the mounting part is provided, said lower mounting stays having projections which are fitted in the inserts of the heat exchangers, said projections being provided with tapered parts oriented to the bracket body side.

* * * * *